US007168918B2

(12) United States Patent
Balan et al.

(10) Patent No.: US 7,168,918 B2
(45) Date of Patent: Jan. 30, 2007

(54) HIGH PERFORMANCE COOLING FAN

(75) Inventors: Chellappa Balan, Niskayuna, NY (US); John Jared Decker, Liberty Town ship, OH (US); Andrew Breeze-Stringfellow, Montgomery, OH (US)

(73) Assignee: General Electric Company, Schenectady, NY (US)

( * ) Notice: Subject to any disclaimer, the term of this patent is extended or adjusted under 35 U.S.C. 154(b) by 188 days.

(21) Appl. No.: 10/955,646

(22) Filed: Sep. 30, 2004

(65) Prior Publication Data

US 2006/0088428 A1 Apr. 27, 2006

(51) Int. Cl.
*F04D 29/44* (2006.01)

(52) U.S. Cl. ..... 415/208.2; 415/211.2; 415/219.1; 415/229

(58) Field of Classification Search ..... 415/208.2, 415/211.2, 219.1, 229; 416/245 R
See application file for complete search history.

(56) References Cited

U.S. PATENT DOCUMENTS 1,997,506 A * 4/1935 Adamcikas et al. ..... 415/192
3,173,604 A * 3/1965 Sheets et al. ..... 415/218.1
3,195,807 A * 7/1965 Sheets ..... 415/220
4,969,797 A * 11/1990 Takara et al. ..... 415/113
5,152,661 A * 10/1992 Sheets ..... 415/84
6,299,408 B1 10/2001 Bhatia ..... 415/176
6,364,004 B1 4/2002 Ehrmann et al. ..... 165/125
6,508,621 B1 * 1/2003 Zeighami et al. ..... 415/119
6,579,064 B2 6/2003 Hsieh ..... 416/182
6,650,540 B2 11/2003 Ishikawa ..... 361/695

* cited by examiner

*Primary Examiner*—Ninh H. Nguyen
(74) *Attorney, Agent, or Firm*—Cantor Colburn LLP

(57) ABSTRACT

A cooling fan comprises a rotor configured to generate airflow. The cooling fan further comprises an outlet guide vane adapted to receive the airflow generated by the rotor and to orient the airflow in a substantially axial direction relative to the rotor. The cooling fan further comprises a diffuser configured to receive the airflow from the outlet guide vane and produce airflow with higher static pressure relative to an inlet of the diffuser. The cooling fan produces a work coefficient greater than 1.6 and a flow coefficient greater than or equal to 0.4.

50 Claims, 6 Drawing Sheets

HIGH PERFORMANCE COOLING FAN

BACKGROUND

The invention relates generally to rotating fans, and more specifically to a fan for cooling an electronic device or other components where a high volumetric flow is desired for removal of heat.

Electronic devices such as servers, processors, memory chips, graphic chips, batteries, radio frequency components, and other devices in electronic equipment generate heat that must be dissipated to avoid damage. Efficient removal of the heat may also enhance the performance of the devices by enabling them to operate at high speeds. If the waste heat generated inside a package or device is not removed, the reliability of the device is compromised. As components increase in performance and speed of operation, they also tend to increase in heat generated. Increased heat generation has resulted in an increased need for improved heat dissipation.

One method of heat removal is the movement of ambient air over the device that is generating heat. The cooling of a device is also improved by placing it in the coolest location in the enclosure. Other thermal solutions for heat removal may comprise using a heat sink, heat pipes, or liquid-cooled heat plates.

Cooling fans play an important role in modern technologies, especially computer cooling. A fan is a device used to move air or gas. Fans are used to move air or gas from one location to another, within or between spaces. Increased airflow significantly lowers the temperature of a heat-generating device by removing the heat from the device to the air, while providing additional cooling for the entire enclosure.

One or more cooling fans may be disposed within an enclosure to create airflow across a heat sink, which may be directly connected to a heat-generating device to gather heat for removal. The heat generated by devices may be sufficiently great that multiple fans are required to generate enough airflow to dissipate the heat to a desirable level. In such cases, multiple fans undesirably occupy a relatively large area within a device enclosure. Additionally, the power consumed by multiple fans exceed desired design thresholds.

Accordingly, a need exists for a cooling fan design that is capable of delivering an increased flow rate without a significant increase in rotational speed.

BRIEF DESCRIPTION

In accordance with one aspect of the present technique, a cooling fan comprises a rotor configured to generate airflow. The cooling fan comprises an outlet guide vane adapted to receive the airflow generated by the rotor and to orient the airflow in a substantially axial direction relative to the rotor. The cooling fan comprises a diffuser configured to receive the airflow from the outlet guide vane and produce airflow with higher static pressure relative to the inlet of the diffuser. The fan produces a work coefficient greater than 1.6 and a flow coefficient greater than or equal to 0.4.

In accordance with another aspect of the present technique, a method of cooling electronic components inside an enclosure comprises driving a rotor to generate airflow. The method comprises receiving an airflow generated by the rotor and orienting the airflow in a substantially axial direction relative to the rotor via an outlet guide vane. The method comprises receiving the airflow from the outlet guide vane and producing airflow with higher static pressure relative to an inlet of the diffuser. The method comprises producing a work coefficient greater than 1.6 and a flow coefficient greater than or equal to 0.4.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
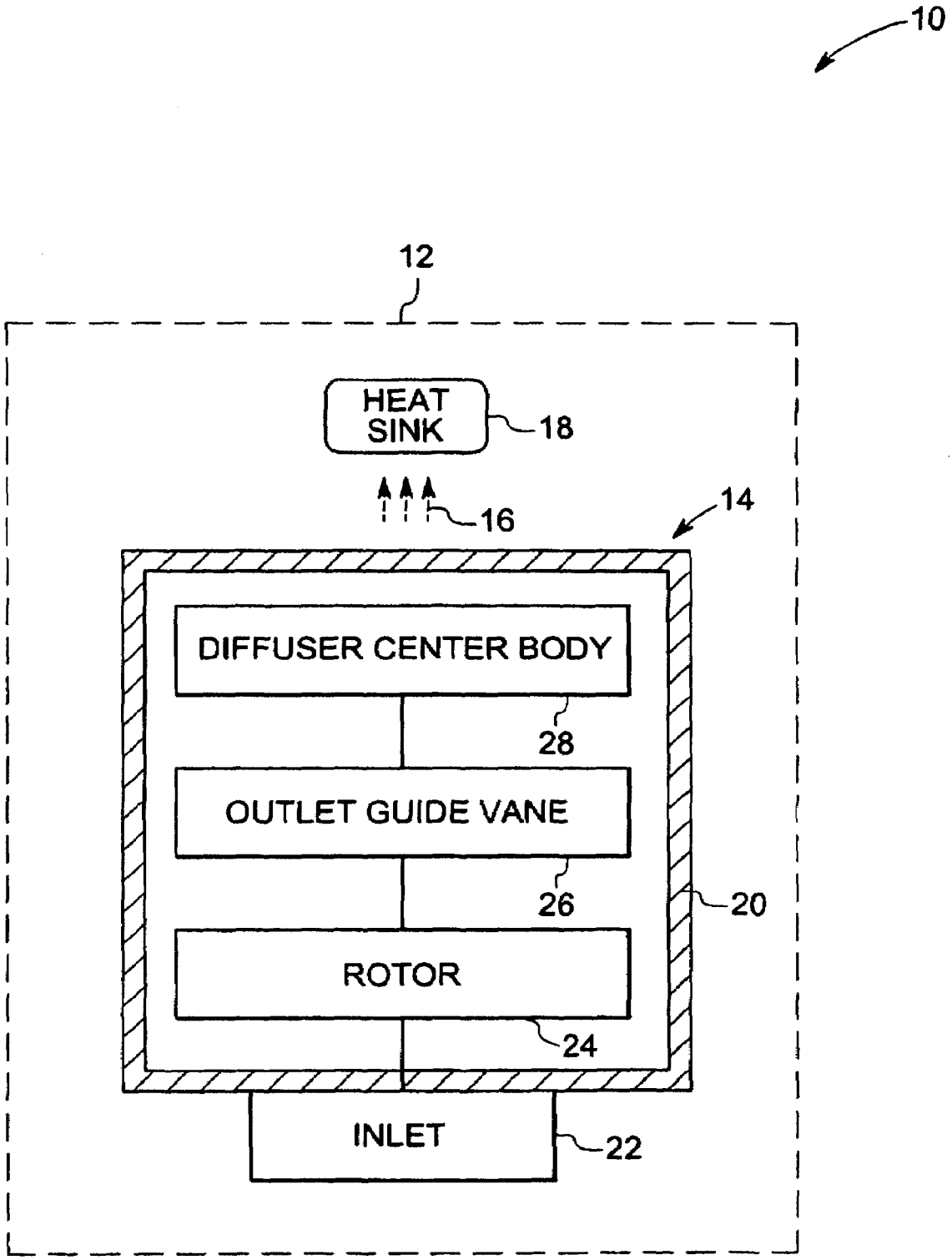
FIG. 1 is a diagrammatical view of an electronic device in accordance with an exemplary embodiment of the present technique.

Referring now to FIG. 1, an electronic device, represented generally by reference numeral 10, is illustrated. As appreciated by those skilled in the art the electronic device may be a server, computer, mobile phone, telecom switch, or the like. The electronic device 10 comprises an enclosure 12, a cooling fan 14, and a heat sink 18. The cooling fan 14, and a heat sink 18 are included inside the enclosure 12. The heat source may be a hard drive, micro-processor, memory chip, graphics chip, battery, radio frequency component video card, system unit, power unit, peripheral or the like.

As known by those skilled in the art, the cooling fan 14 is used to cool a single heat source or a combination thereof. Fans are usually driven by an electric motor. The high work coefficients and the application may require high rotation speeds in excess of 20000 (RPM) revolutions per minute. To facilitate reliable operation, the motor and fan rotor in one preferred embodiment could consist of a fluid dynamic or air bearing, which extend the life of the fan motor assembly. In another preferred embodiment, the motor and fan rotor could consist of a rolling element contact bearing. Of course, those of ordinary skill in the art will appreciate that any number of bearings are envisaged. In the illustrated embodiment, the cooling fan 14 comprises a casing 20, an inlet 22, a rotor 24, an outlet guide vane 26, and a diffuser center body 28. In the illustrated embodiment, the fan assembly 14 is located upstream relative to heat sink 18 such that the airflow 16 from the fan assembly 14 is directed to the heat sink 18 for removal of the heat. In other embodiments, the fan assembly is located downstream relative to the heat sink 18 such that the airflow inlet 22 may be adapted to receive air from the heat sink 18 prior to passing through the fan assembly 14. In another embodiment, the outlet guide vane may be used as or part of the heat sink. In yet another embodiment, the heat sink may be integrated with the airflow inlet.

The heat sink 18 may be an active heat sink. The heat sink design may include fins or protrusions to increase the surface area. In one embodiment, cooling fan 14 provides air directly to the heat sink, thereby enabling the sink to be an active component. Increased airflow generated by the fan lowers the temperature of the heat source, while providing additional cooling for all the components provided inside the enclosure 12. Increased airflow also increases the cooling efficiency of the heat sink allowing a relatively smaller heat sink to perform cooling operation adequately. The single fan arrangement with higher efficiency delivers the required airflow and occupies less space and consumes less power.

Figure 2:
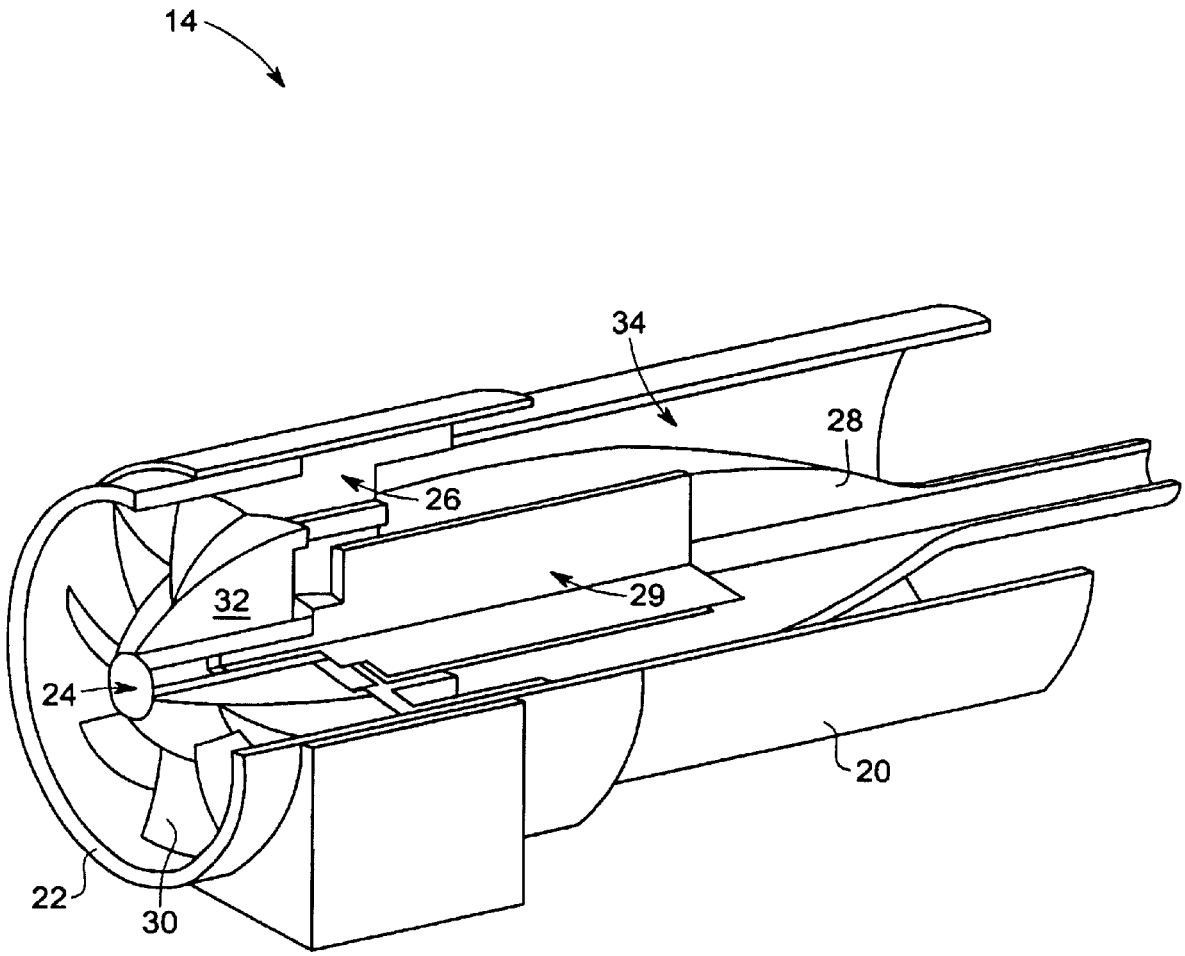
FIG. 2 is a diagrammatical view of a cooling fan in accordance with an exemplary embodiment of the present technique.

Referring generally to FIG. 2, a cooling fan in accordance with one aspect of the present technique is illustrated. In the illustrated embodiment, the inlet 22 is provided to one end of the casing 20. The rotor 24, the outlet guide vane 26 and diffuser center body 28 are provided inside the casing 20. Additionally a drive motor 29 is also provided inside the casing 20. The inlet 22 is configured to direct the air to the rotor 24. In the illustrated embodiment, the rotor 24 comprises multiple rotor blades 30 and a rotor hub 32. The outer casing 20 and the diffuser center body 28 forms the diffuser 34.

The reynolds number of a fan is defined as the ratio of inertial force to viscous force of air or other fluids. When reynolds number is low, viscosity factor is dominant leading to separation of air at the suction surface of the blade. Smaller size fans typically have a low reynolds number. In the illustrated embodiment, the rotor comprises a relatively small number of blades (eight blades are shown for exemplary purposes). The blades have a relatively long chord length. The chord of the blade is defined as the axial length between the leading edge and the trailing edge of the blade. The reynolds number is proportional to the chord length. The factors such as smaller number of blades and longer chord of the blades facilitate an increased reynolds number for embodiments of the present technique. As a result, viscous force is less dominant.

The chord solidity of the rotor is determined based on the following relation:

$$\text{chord solidity} = \frac{\text{chord} \times \text{number of blades}}{\text{circumference}}$$

In the illustrated embodiment, the chord solidity may be in the range of 1 to 2.5.

In one embodiment, the cooling fan 14 operates at a reynolds number which is less than or equal to 100,000 for electronic devices of smaller configuration such as a 1U computer enclosure. In another embodiment, the cooling fan 14 operates at a reynolds number which is less than or equal to 500,000 for electronic devices of larger configuration. The exemplary cooling fan produces an airflow coefficient above 0.4 at a reynolds number which is less than or equal to 100,000. The airflow coefficient is defined according to the following relation:

$$\text{Airflow coefficient} = \frac{c_z}{u},$$

where $c_z$ is the rotor inlet average axial velocity;

"u" is the rotor inlet pitch line wheel speed.

In the illustrated embodiment the exemplary cooling fan produces a work coefficient above 1.6. The work coefficient is defined according to the following relation:

$$\text{Work coefficient} = \frac{2 \times \Delta H}{u^2},$$

where ΔH is an enthalpy rise.

The rotor hub 32 has a sloping configuration, which means that the radius of the rotor hub increases from the leading edge of the blade to the trailing edge of the blade. The sloping configuration of the rotor hub facilitates a higher pressure rise at the same rotational speed and lower reynolds number. The sloping configuration also reduces the aerodynamic loading on the rotor. The airflow efficiency is also improved. The rotor also has substantially low aspect ratio defined as the ratio of the blade height to the chord. In some embodiments, the aspect ratio is in the range of 0.3 to 2.5. In some preferred embodiments, the aspect ratio is in the range of 0.3 to 2. In the illustrated embodiment, the aspect ratio of the rotor is 0.4. In one embodiment, the rotor also comprises a cylindrical tip so that the clearance between the rotor and the casing is insensitive to the axial location of the rotor. In another embodiment, the rotor comprises a conical converging tip. In yet another embodiment, the rotor comprises a conical diverging tip. Circumferential grooves, grooves with baffles, or grooves with ramped baffles may be provided on the rotor tip to extend the stable operating range of the rotor.

The outlet guide vane 26 receives the airflow generated by the rotor and transforms the airflow in a substantially axial direction relative to the rotor. An air static pressure rise is achieved through the outlet guide vane 26. The number of vanes in the outlet guide vane 26 to the number of airfoil shaped blades in the rotor 24 is called the vane blade ratio. In some preferred embodiments, the blade vane ratio is greater than 2. In the illustrated embodiment, the vane blade ratio is 2.9. The annulus configuration of the outlet guide vane 26 is referred to as area ruling of the outlet guide vane. In the illustrated embodiment, the rotor 24 and the outlet guide vane 26 constitute airfoils. As appreciated by those skilled in the art, a computational fluid dynamics tool is used to design the shape of airfoil blades to eliminate separation of air at the suction surface of the blade, at low reynolds number.

The diffuser 34 is configured to receive airflow from the outlet guide vane 26. The axial velocity of the airflow is reduced via the diffuser 34. The diffuser 34 allows substantially more airflow through the fan at the same pressure ratio. The task of the diffuser 34 is to eject air and minimize separation. The diffusion of air through the diffuser 34 recovers a large portion of the pressure head by reducing the air velocity as the diffuser 34 has substantially larger exit area relative to the inlet area of the diffuser 34. The diffuser 34 may be either axi-symmetric shaped or non axi-symmetric shaped.

Figure 3:
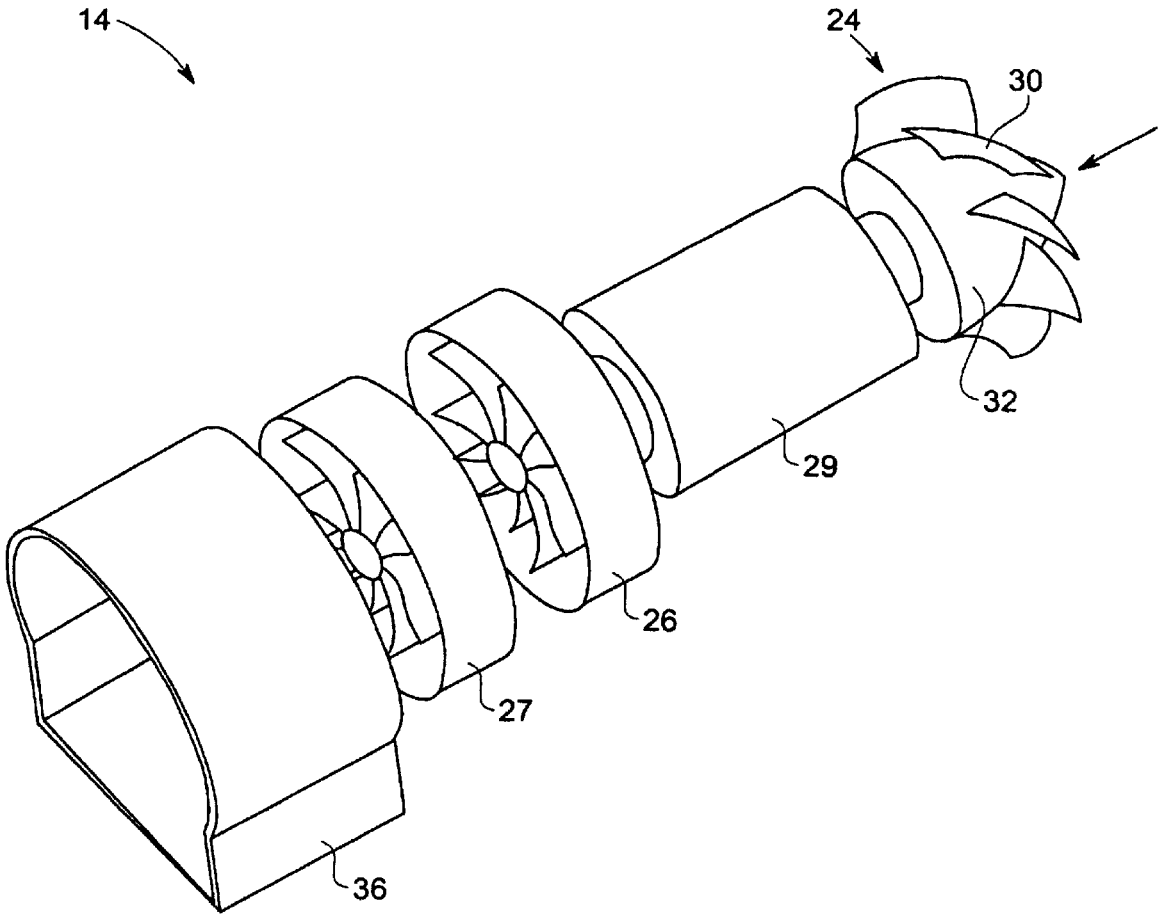
FIG. 3 is a diagrammatical view of a cooling fan in accordance with an exemplary embodiment of the present technique.

Referring generally to FIG. 3, another embodiment of the cooling fan 14 is illustrated. In the illustrated embodiment, the cooling fan 14 comprises the rotor 24, the electric motor 29, the outlet guide vane 26, a strut frame 27, and a vapor chamber 36. The exemplary strut frame 27 comprises a plurality of struts for providing mechanical support to the diffuser center body, which is not shown. In the illustrated embodiment, the struts also acts as fins to dissipate heat from the vapor chamber to the air. The illustrated vapor chamber 36 is a vacuum vessel with a working fluid. As heat is applied, fluid immediately vaporizes and the vapor rushes to fill the vacuum. The vapor comes into contact with cooler wall regions causing condensation and release of latent heat of vaporization. The condensed fluid returns to the heat source, ready to be vaporized again. The cycle is then repeated. The vapor chamber spreads heat to help eliminate localized hot spots.

Figure 4:
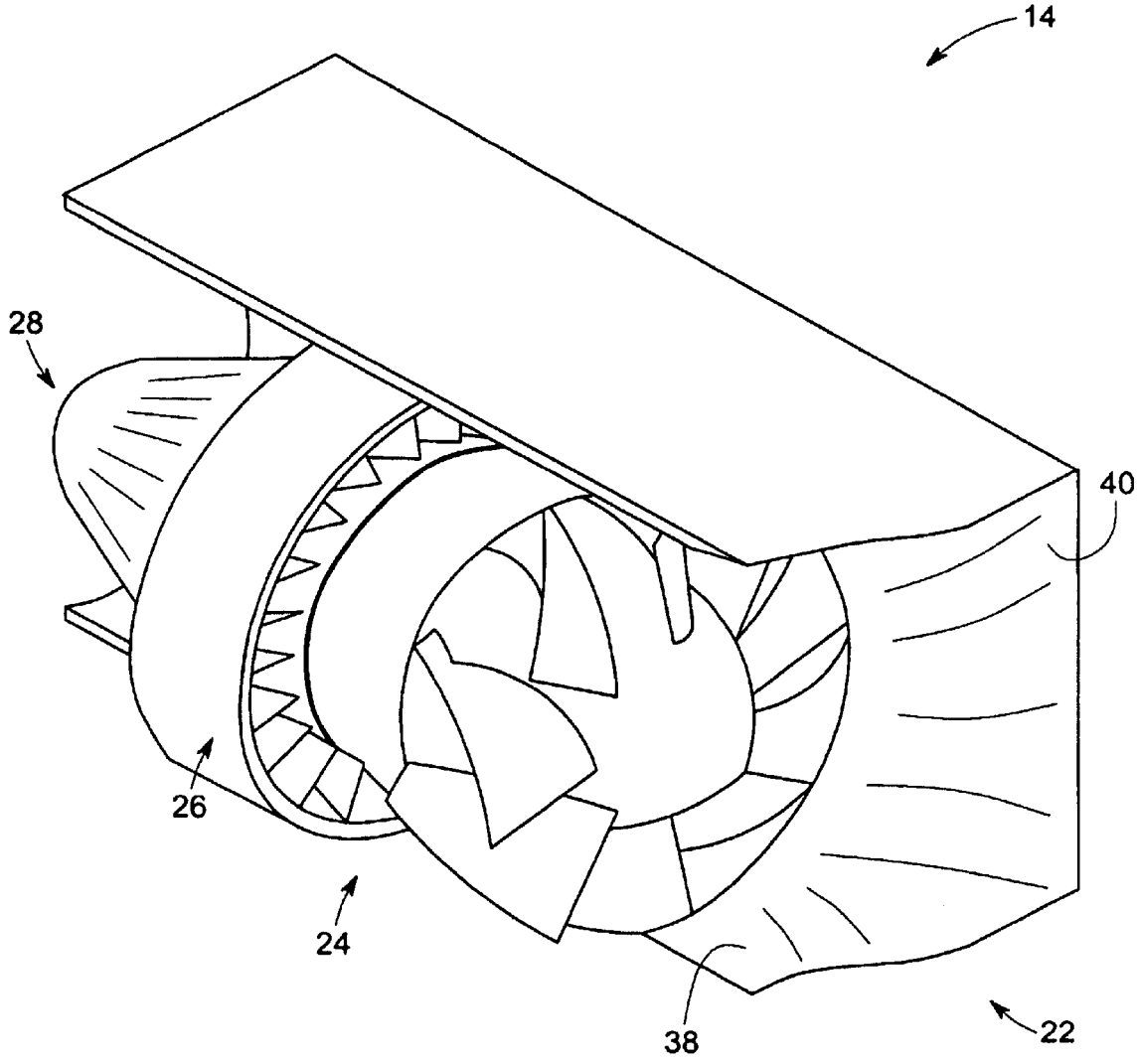
FIG. 4 is a diagrammatical view of a non axi-symmetric inlet of a cooling fan in accordance with an exemplary embodiment of the present technique.

Referring to FIG. 4, a cooling fan 14 with a non axi-symmetric inlet 22 is illustrated. In the illustrated embodiment, the non axi-symmetric 22 inlet comprises a circular section 38, and a rectangular section 40. The non axi-symmetric inlet 22 is provided to direct the air into the rotor 24 with minimal losses.

Figure 5:
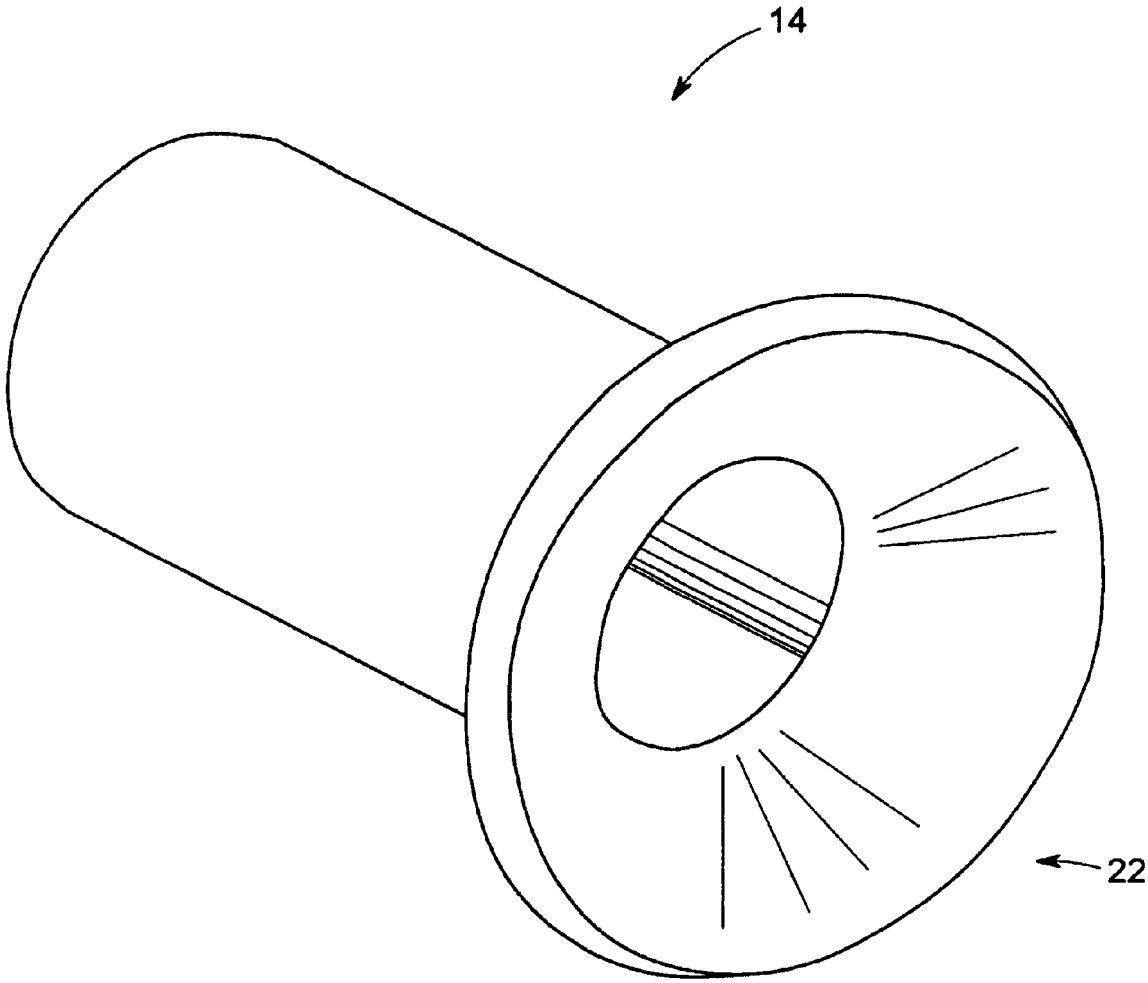
FIG. 5 is a diagrammatical view of an axi-symmetric inlet of a cooling fan in accordance with an exemplary embodiment of the present technique.

Referring to FIG. 5, a cooling fan 14 with an axi-symmetric inlet 22 is illustrated. In the illustrated embodiment, the axi-symmetric inlet 22 comprises a bell mouth section, which is symmetric along the axial direction.

Figure 6:
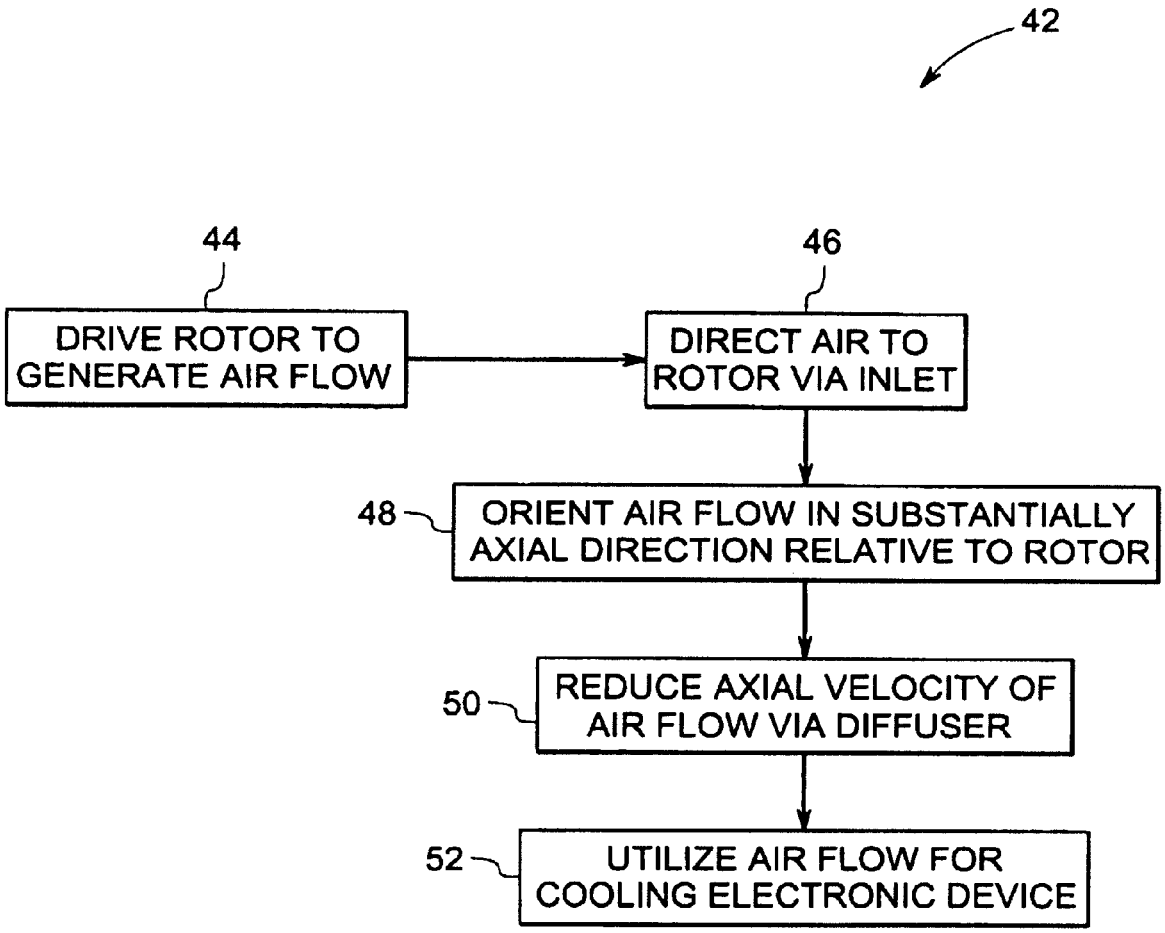
FIG. 6 is a flow chart illustrating a method of cooling an electronic device in accordance with aspects of the present technique.

FIG. 6 is a flow chart illustrating a cooling process in accordance with embodiments of the present technique. The cooling process, which is designated by reference numeral 42, may begin with driving the rotor to generate airflow as indicated by step 44 of FIG. 6. At step 46, air is directed to the rotor via an inlet. The air may be directed to the rotor in such a way that minimal losses occur. The air separation at the suction surface of the rotor blades is reduced or minimized. The aerodynamic loading on the rotor may also be reduced.

At step 48, the airflow from the rotor is oriented in a substantially axial direction relative to the rotor. At step 50, the diffuser receives the airflow from the outlet guide vane and produces airflow with higher static pressure relative to the inlet of the diffuser. The diffuser reduces the axial velocity of the airflow. At step 52, the airflow generated via the diffuser is utilized for cooling the heat generating components provided inside the enclosure of an electronic device. In one embodiment, the airflow from the fan assembly is directed to the heat sink for removal of the heat. In another embodiment, the airflow inlet is adapted to receive air from the heat sink 18 prior to passing through the fan assembly for removal of heat. In accordance with the present technique, the cooling fan produces a work coefficient greater than 1.6 and a flow coefficient greater than or equal to 0.4.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A cooling fan for cooling electronic components in an enclosure, the cooling fan comprising:

a rotor configured to generate an airflow, the rotor comprising a number of rotor blades and a hub with a sloping configuration such that a radius of the hub increases from a leading edge of a rotor blade to a trailing edge of the same rotor blade;

an outlet guide vane adapted to receive the airflow generated by the rotor and to orient the airflow in a substantially axial direction relative to the rotor, the outlet guide vane comprising a number of vanes greater than the number of rotor blades and being configured so as to cause an air static pressure rise through the outlet guide vane; and a diffuser configured to receive the airflow from the outlet guide vane and produce an airflow with higher static pressure relative to an inlet of the diffuser;

wherein the rotor, outlet guide vane, and diffuser, are configured such that the cooling fan produces a work coefficient greater than 1.6 and a flow coefficient greater than or equal to 0.4.

2. The cooling fan of claim 1, wherein the cooling fan operates at a reynolds number which is less than or equal to 500,000.

3. The cooling fan of claim 1, wherein the cooling fan operates at a reynolds number which is less than or equal to 100,000.

4. The cooling fan of claim 1, wherein the cooling fan has a vane to blade ratio greater than 2.

5. The cooling fan of claim 1, further comprising a vapor chamber adapted to spread heat generated by the electronic components.

6. The cooling fan of claim 1, further comprising an axi-symmetric inlet configured to direct the air to the rotor.

7. The cooling fan of claim 6, wherein the inlet is bell-mouth shaped.

8. The cooling fan of claim 1, further comprising a non-axi-symmetric inlet configured to direct air to the rotor.

9. The cooling fan of claim 1, wherein the rotor comprises a rotor hub and a plurality of blades.

10. The cooling fan of claim 9, wherein the radius of the rotor hub increases from a blade leading edge to a blade trailing edge.

11. The cooling fan of claim 9, wherein the rotor comprises not more than eight blades.

12. The cooling fan of claim 9, wherein the rotor comprises a cylindrical tip.

13. The cooling fan of claim 9, wherein the rotor comprises a conical diverging tip.

14. The cooling fan of claim 9, wherein the rotor comprises a conical converging tip.

15. The cooling fan of claim 9, wherein the rotor has a chord solidity in the range of 1 to 2.5.

16. The cooling fan of claim 9, wherein the rotor has an aspect ratio in the range of 0.3 to 2.

17. The cooling fan of claim 9, wherein the rotor has an aspect ratio in the range of 0.3 to 2.5.

18. The cooling fan of claim 1, wherein the outlet guide vane is adapted to achieve area ruling.

19. The cooling fan of claim 1, wherein the diffuser comprises a plurality of struts configured to provide mechanical support to a diffuser center body.

20. The cooling fan of claim 1, wherein the rotor is driven by an electrical motor with a fluid dynamic air bearing.

21. The cooling fan of claim 1, wherein the rotor is driven by an electrical motor with a rolling element contact bearing.

22. An electronic device, comprising:

at least one heat sink for dissipating heat generated by a source of heat; and a cooling fan adapted to remove an amount of heat generated by the source of heat, the cooling fan comprising:

a rotor configured to generate an airflow, the rotor comprising a number of rotor blades and a hub with a sloping configuration such that a radius of the hub increases from a leading edge of a rotor blade to a trailing edge of the rotor blade;

an outlet guide vane adapted to receive the airflow generated by the rotor and to orient the airflow in a substantially axial direction relative to the rotor, the outlet guide vane comprising a number of vanes greater than the number of rotor blades and being configured so as to cause an air static pressure rise through the outlet guide vane; and a diffuser configured to receive the airflow from the outlet guide vane and produce an airflow with higher static pressure relative to an inlet of the diffuser;

wherein the rotor, outlet guide vane, and diffuser, are configured such that the fan produces a work coefficient greater than 1.6 and a flow coefficient greater than or equal to 0.4.

23. The electronic device of claim 22, wherein the cooling fan is provided upstream relative to the heat sink.

24. The electronic device of claim 22, wherein the cooling fan is provided downstream relative to the heat sink.

25. The electronic device of claim 22, wherein the cooling fan is adapted to direct air to the heat sink.

26. The electronic device of claim 22, wherein the cooling fan operates at a reynolds number which is less than or equal to 500,000.

27. The electronic device of claim 22, wherein the cooling fan operates at a reynolds number which is less than or equal to 100,000.

28. The electronic device of claim 22, wherein the cooling fan has a vane to blade ratio greater than 2.

29. The electronic device of claim 22, wherein the cooling fan comprises a vapor chamber adapted to spread heat generated by the source of heat.

30. The electronic device of claim 22, wherein the cooling fan comprises an inlet adapted to receive air from the heat sink.

31. The electronic device of claim 22, wherein the cooling fan comprises an axi-symmetric inlet configured to direct the air to the rotor.

32. The electronic device of claim 31, wherein the inlet is bell-mouth shaped.

33. The electronic device of claim 22, wherein the cooling fan comprises a non-axi-symmetric inlet configured to direct the air to the rotor.

34. The electronic device of claim 22, wherein the rotor comprises a rotor hub and a plurality of blades.

35. The electronic device of claim 34, wherein a radius of the rotor hub increases from a blade leading edge to a blade trailing edge.

36. The electronic device of claim 34, wherein the rotor comprises not more than eight blades.

37. The electronic device of claim of 34, wherein the rotor comprises a cylindrical tip.

38. The electronic device of claim 34, wherein the rotor comprises a conical diverging tip.

39. The electronic device of claim 34, wherein the rotor comprises a conical converging tip.

40. The electronic device of claim 34, wherein the rotor has a chord solidity in the range of 1 to 2.5.

41. The electronic device of claim 34, wherein the rotor has an aspect ratio in the range of 0.3 to 2.5.

42. The electronic device of claim 22, wherein the outlet guide vane is adapted to achieve area ruling.

43. The electronic device of claim 22, wherein the diffuser comprises a plurality of struts configured to provide mechanical support to the diffuser center body.

44. The electronic device of claim 22, wherein the rotor is driven by an electrical motor with a fluid dynamic air bearing.

45. The electronic device of claim 22, wherein the rotor is driven by an electrical motor with a rolling element contact bearing.

46. A method of cooling electronic components inside an enclosure via a cooling fan, the method comprising:

driving a rotor to generate an air flow over a sloping configuration that facilitates a higher pressure rise at a given rotational speed and at a lower Reynolds number;

receiving an airflow generated by the rotor and orienting the airflow in a substantially axial direction relative to the rotor via an outlet guide vane, causing an air static pressure rise through the outlet guide vane;

receiving the air flow from the outlet guide vane and producing an airflow with higher static pressure relative to an inlet of a diffuser; and producing via the cooling fan a work coefficient greater than 1.6 and a flow coefficient greater than or equal to 0.4.

47. The method of claim 46, further comprising operating the cooling fan at a reynolds number which is less than or equal to 500,000.

48. The method of claim 46, further comprising operating the cooling fan at a reynolds number which is less than or equal to 100,000.

49. The method of claim 46, further comprising directing air to the rotor via an inlet.

50. The method of claim 46, wherein the airflow is utilized for cooling an electronic device.

* * * * *